US008526844B2

(12) United States Patent
Ichikawa et al.

(10) Patent No.: US 8,526,844 B2
(45) Date of Patent: Sep. 3, 2013

(54) CLEANING DEVICE AND IMAGE FORMING APPARATUS

(75) Inventors: Yuzo Ichikawa, Kanagawa (JP); Yasuo Takayama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 272 days.

(21) Appl. No.: 12/985,130

(22) Filed: Jan. 5, 2011

(65) Prior Publication Data

US 2011/0318046 A1 Dec. 29, 2011

(30) Foreign Application Priority Data

Jun. 24, 2010 (JP) ..... 2010-143764

(51) Int. Cl.
*G03G 15/02* (2006.01)

(52) U.S. Cl.
USPC ..... 399/100

(58) Field of Classification Search
USPC ..... 399/100–101
See application file for complete search history.

(56) References Cited

U.S. PATENT DOCUMENTS

| | | | | |
|---|---|---|---|---|
| 4,788,573 | A * | 11/1988 | Nakaoka et al. | 399/100 |
| 4,885,466 | A * | 12/1989 | Koichi et al. | 399/34 |
| 2005/0063727 | A1* | 3/2005 | Quinones | 399/100 |
| 2008/0226334 | A1* | 9/2008 | Ohno et al. | 399/100 |

FOREIGN PATENT DOCUMENTS

| | | |
|---|---|---|
| JP | 63-229467 | 9/1988 |
| JP | 6-149021 | 5/1994 |
| JP | 10-90983 | 4/1998 |
| JP | 2009-271344 | 11/2009 |

* cited by examiner

*Primary Examiner* — G. M. Hyder
(74) *Attorney, Agent, or Firm* — Sughrue Mion, PLLC

(57) ABSTRACT

There is provided a cleaning device including: a cleaning member disposed that cleans the discharge member; a guide member disposed along the length direction of the discharge member and guides the cleaning member in the length direction of the discharge member; and a drive device which, when executing a cleaning operation where the drive device reciprocally moves the cleaning member along the guide member from a standby position set on one length direction end portion of the discharge member or a return operation where the drive device returns the cleaning member along the guide member to the standby position, applies to the cleaning member a driving force in an opposite direction of a moving direction in which movement of the cleaning member is to be started and thereafter applies to the cleaning member a driving force in the moving direction.

6 Claims, 11 Drawing Sheets

CLEANING DEVICE AND IMAGE FORMING APPARATUS

CROSS-REFERENCE TO RELATED APPLICATION

This application is based on and claims priority under 35 USC 119 from Japanese Patent Application No. 2010-143764 filed on Jun. 24, 2010.

BACKGROUND

1. Technical Field

The present invention relates to a cleaning device and an image forming apparatus.

2. Related Art

There is a related technology for cleaning a discharge member of a charging device.

SUMMARY

According to a first aspect of the invention, there is provided a cleaning device including: a cleaning member that is disposed so as to be movable along a length direction of, and in contact with, a discharge member of a charging device and cleans the discharge member; a guide member that is disposed along the length direction of the discharge member and guides the cleaning member in the length direction of the discharge member; and a drive device which, when executing a cleaning operation where the drive device reciprocally moves the cleaning member along the guide member from a standby position set on one length direction end portion of the discharge member or a return operation where the drive device returns the cleaning member along the guide member to the standby position, applies to the cleaning member a driving force in an opposite direction of a moving direction in which movement of the cleaning member is to be started and thereafter applies to the cleaning member a driving force in the moving direction.

BRIEF DESCRIPTION OF THE DRAWINGS

An exemplary embodiment of the present invention will be described in detail based on the following figures, wherein.

DETAILED DESCRIPTION

An exemplary embodiment pertaining to the present invention will be described below on the basis of the drawings.

(Configuration of Image Forming Apparatus Pertaining to Present Exemplary Embodiment)

Figure 1:
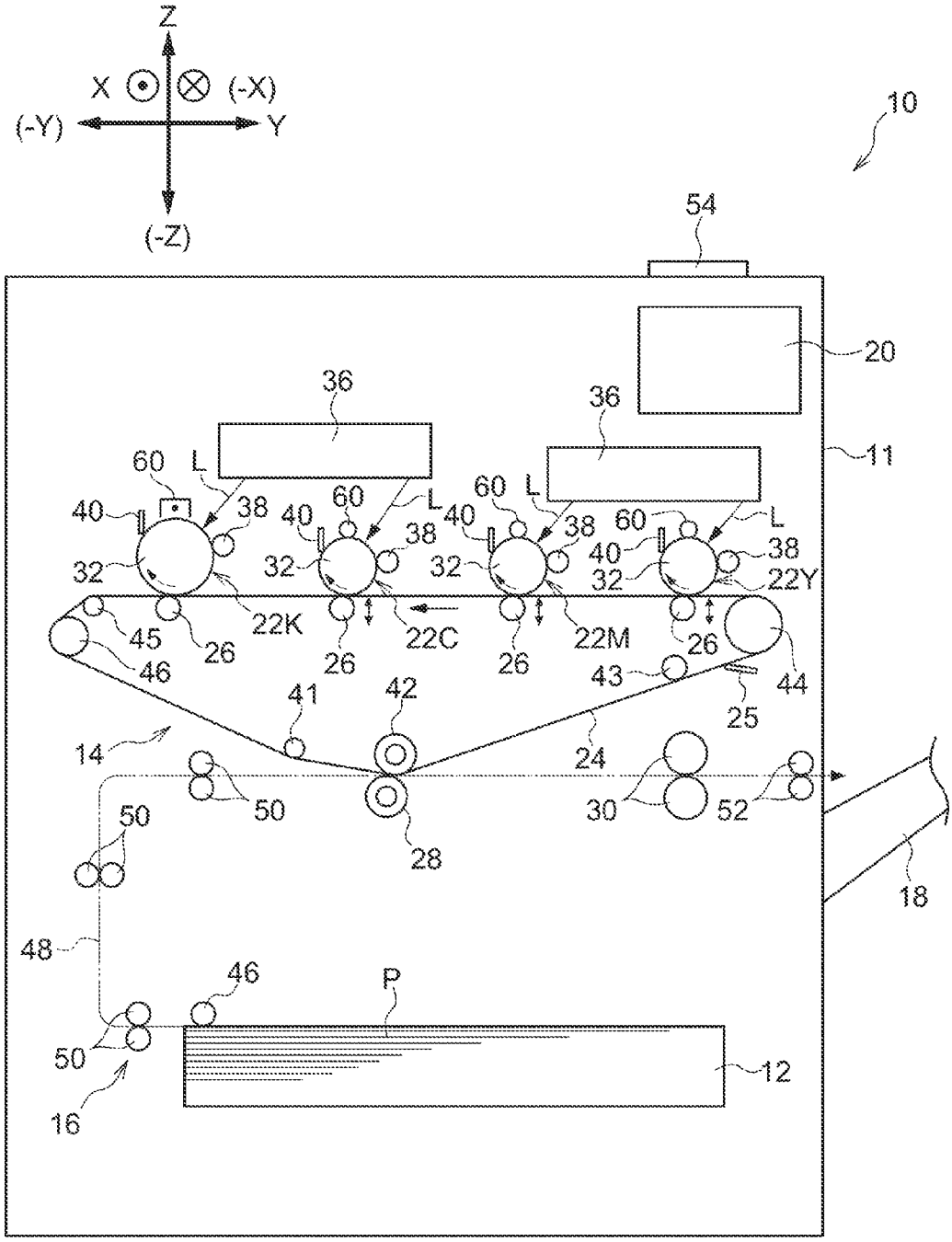
FIG. 1 is a general view showing the configuration of an image forming apparatus pertaining to the exemplary embodiment.

First, the configuration of an image forming apparatus 10 pertaining to the present exemplary embodiment will be described. FIG. 1 is a general view showing the configuration of the image forming apparatus 10 pertaining to the present exemplary embodiment.

In order to facilitate understanding of the description hereinafter, in the drawings, the X-axis direction denotes a front-back direction, the Y-axis direction denotes a left-right direction, and the Z-axis direction denotes an up-down direction. The directions indicated by arrows X, −X, Y, −Y, Z, and −Z denote front, back, right, left, up, and down, respectively. Further, in drawings showing a configuration two-dimensionally, a X or a Z accompanied by a circled dot means an arrow from the back to the front of the page and a −X or a −Z accompanied by a circled times means an arrow from the front to the back of the page.

As shown in FIG. 1, the image forming apparatus 10 is equipped with an image forming apparatus body 11 inside of which are housed components. Inside the image forming apparatus body 11, there are disposed a recording medium housing unit 12 in which a recording medium P such as paper is housed, an image forming section 14 that forms images on the recording medium P, a conveyance section 16 that conveys the recording medium P from the recording medium housing unit 12 to the image forming section 14, and a controller 20 that controls the working of each part of the image forming apparatus 10. Further, on the side portion of the image forming apparatus body 11, there is disposed a recording medium ejection unit 18 to which is ejected the recording medium P on which an image has been formed by the image forming section 14.

The image forming section 14 is equipped with image forming units 22Y, 22M, 22C, and 22K (hereinafter "22Y to 22K") that form toner images of each color of yellow (Y), magenta (M), cyan (C), and black (K), an intermediate transfer belt 24 onto which are transferred the image images that have been formed by the image forming units 22Y to 22K, first transfer rolls 26 serving as one example of first transfer members for transferring onto the intermediate transfer belt 24 the toner images that have been formed by the image forming units 22Y to 22K, a second transfer roll 28 serving as one example of a second transfer member for transferring from the intermediate transfer belt 24 to the recording medium P the toner images that have been transferred onto the intermediate transfer belt 24 by the first transfer rolls 26, and a fixing device 30 that fixes to the recording medium P the toner images that have been transferred from the intermediate transfer belt 24 to the recording medium P by the second transfer roll 28.

The image forming units 22Y to 22K are juxtaposed and placed in the vertical direction central portion of the image forming apparatus 10 along the horizontal direction. Further, each of the image forming units 22Y to 22K has a photoconductor 32 (one example of a charged body) that rotates in one direction (a clockwise direction in FIG. 1).

Figure 2:
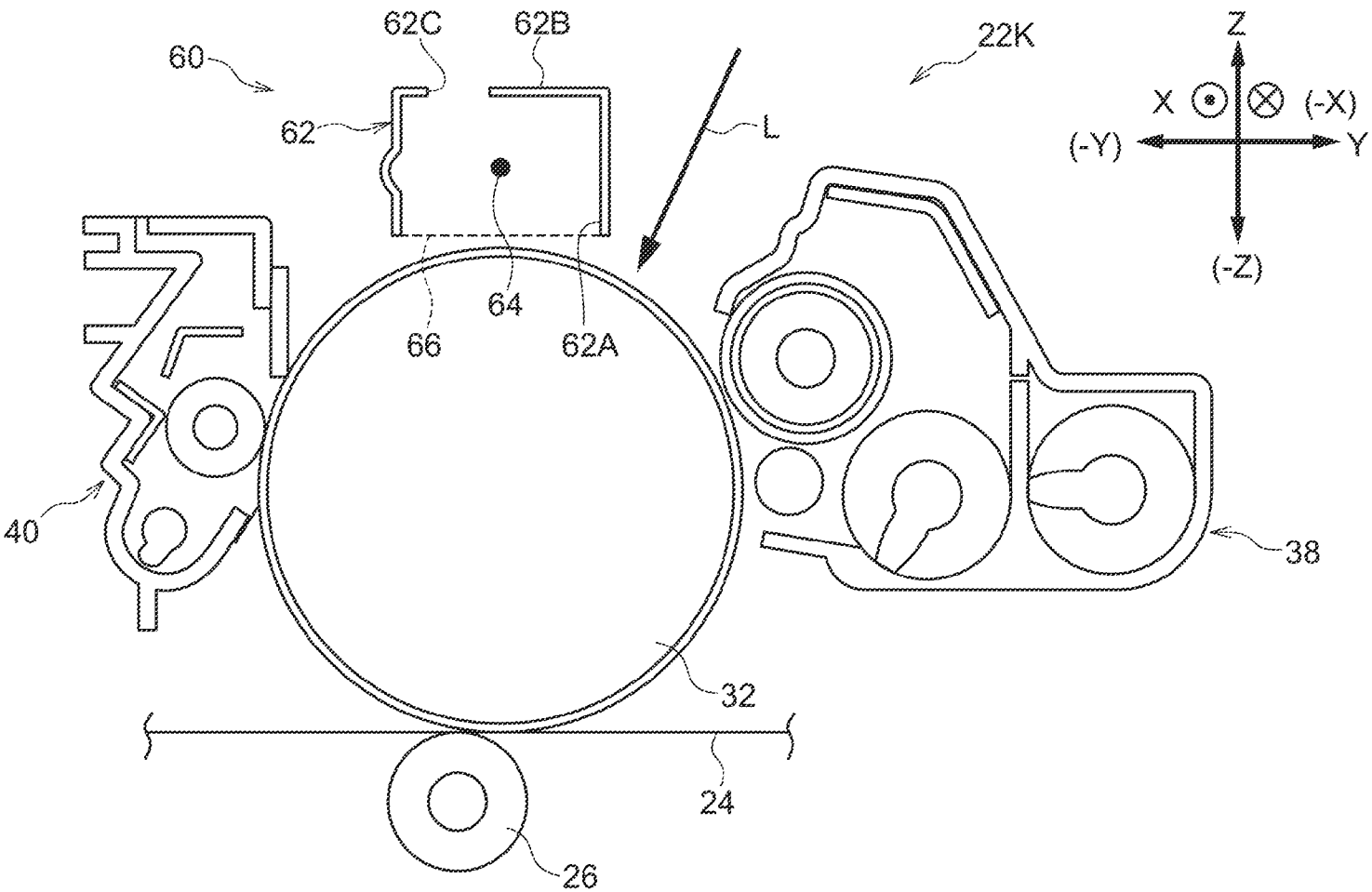
FIG. 2 is a general view showing the configuration of an image forming unit pertaining to the exemplary embodiment.

Around each of the photoconductors 32, in order from the upstream side in the rotating direction of the photoconductor 32, there are disposed a charging device 60 that charges the photoconductor 32, a developing device 38 that forms a toner image by developing an electrostatic latent image that has been formed as a result of the photoconductor 32 charged by the charging device 60 being exposed to light, and a neutralizing device 40 that neutralizes developer remaining on the photoconductor 32 after image transfer (see FIG. 2).

In the image forming units 22Y, 22M, and 22C, the charging device 60 is configured by a charging roll. In the image forming unit 22K, the charging device 60 is, as shown in FIG. 2, configured by a scorotron charging device. The specific configuration of this scorotron charging device 60 will be described later.

Further, above the image forming units 22Y to 22K, as shown in FIG. 1, there are disposed exposure devices 36 that form electrostatic latent images by exposing each of the photoconductors 32 charged by the charging device 60 to light. The exposure devices 36 are configured to form the electrostatic latent images on the basis of image signals sent from the controller 20. Examples of the image signals sent from the controller 20 include image signals that the controller 20 has acquired from the outside. In FIG. 1 and FIG. 2, arrows L indicate exposure light beams from the exposure devices 36.

The intermediate transfer belt 24 is, as shown in FIG. 1, formed annularly and placed on the underside of the image forming units 22Y to 22K. On the inner peripheral side of the intermediate transfer belt 24, there are disposed wrap rolls 41, 42, 43, 44, 45, and 46 around which the intermediate transfer belt 24 is wrapped. The intermediate transfer belt 24 is configured to circulatingly move (rotate) in one direction (a counter-clockwise direction in FIG. 1) while contacting the photoconductors 32 as a result of any of the wrap rolls 41, 42, 43, 44, 45 and 46 being driven to rotate. The wrap roll 42 is configured as an opposing roll that opposes the second transfer roll 28.

Further, on the outer peripheral side of the intermediate transfer belt 24, there is disposed a neutralizing device 25 that contacts the outer peripheral surface of the intermediate transfer belt 24 and neutralizes developer remaining on the intermediate transfer belt 24 after image transfer.

The first transfer rolls 26 oppose the photoconductors 32 across the intermediate transfer belt 24. The positions between the first transfer rolls 26 and the photoconductors 32 are configured as first transfer positions where the toner images formed on the photoconductors 32 are transferred onto the intermediate transfer belt 24. Further, the first transfer rolls 26 contact the intermediate transfer belt 24 and are configured to rotate following the circulatingly moving intermediate transfer belt 24.

The second transfer roll 28 opposes the wrap roll 42 across the intermediate transfer belt 24. The position between the second transfer roll 28 and the wrap roll 42 is configured as a second transfer position where the toner images transferred onto the intermediate transfer belt 24 are transferred onto the recording medium P.

In the conveyance section 16, there are disposed a feed roll 46 that feeds the recording medium P housed in the recording medium housing unit 12, a conveyance path 48 on which the recording medium P fed by the feed roll 46 is conveyed, and multiple conveyance rolls 50 that are placed along the conveyance path 48 and convey the recording medium P fed by the feed roll 46 to the second transfer position.

The fixing device 30 is placed on the conveyance direction downstream side of the second transfer position and fixes to the recording medium P the toner images that have been transferred at the second transfer position. On the conveyance direction downstream side of the fixing device 30, there are disposed ejection rolls 52 that eject to the recording medium ejection unit 18 the recording medium P to which the toner images have been fixed.

Next, the image forming operations of forming an image on the recording medium P in the image forming apparatus 10 pertaining to the present exemplary embodiment will be described.

In the image forming apparatus 10 pertaining to the present exemplary embodiment, the recording medium P fed by the feed roll 46 from the recording medium housing unit 12 is sent to the second transfer position by the multiple conveyance rolls 50.

Meanwhile, in the image forming units 22Y to 22K, the photoconductors 32 charged by the charging devices 60 are exposed to light by the exposure devices 36, whereby electrostatic latent images are formed on the photoconductors 32. Those electrostatic latent images are developed by the developing devices 38, whereby toner images are formed on the photoconductors 32. The toner images of each color formed by the image forming units 22Y to 22K are superimposed on the intermediate transfer belt 24 in the first transfer positions, whereby a color image is formed. Then, the color image formed on the intermediate transfer belt 24 is transferred to the recording medium P in the second transfer position.

The recording medium P onto which the toner images have been transferred is conveyed to the fixing device 30, and the toner images that have been transferred are fixed by the fixing device 30. The recording medium P to which the toner images have been fixed is ejected to the recording medium ejection unit 18 by the ejection rolls 52. As described above, the series of image forming operations is performed.

(Configuration of Charging Devices 60)

Next, the configuration of the charging devices 60 will be described.

Figure 3:
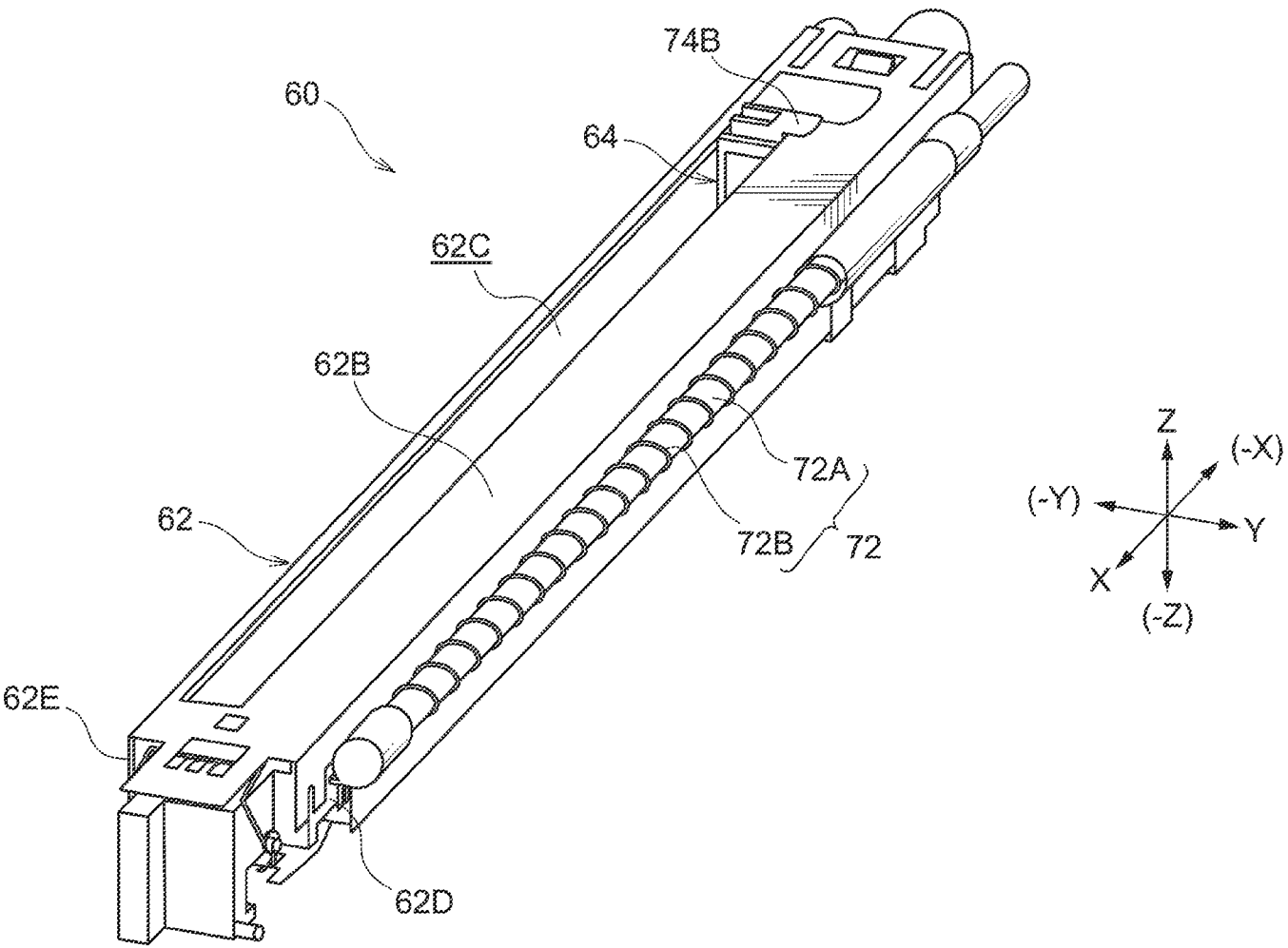
FIG. 3 is a perspective view showing the configuration of a charging device pertaining to the exemplary embodiment.

Each of the charging devices 60 is, as shown in FIG. 2, equipped with a shield case 62 serving as one example of a guide member and made of stainless steel in which an open portion 62A is formed on the photoconductor 32 side. The shield case 62 is configured in the form of a long and slender box that extends along the axis-of-rotation direction of the photoconductor 32 (see FIG. 3). In an upper wall 62B of the shield case 62, there is formed a ventilation opening 62C for ventilation.

Inside the shield case 62, as shown in FIG. 2, a discharge wire 64 serving as one example of a discharge member is disposed along the axis-of-rotation direction of the photoconductor 32. The discharge wire 64 is configured by a metal wire of tungsten, for example. The discharge member may also be a discharge member configured by a metal wire coated with a resin or by a tabular metal plate; it suffices as long as the discharge member is one by which discharge is performed.

The discharge wire 64 is configured to perform a discharge operation where it generates a negative charge as a result of a voltage being applied thereto from a power source 68 (see FIG. 6) and supplies this negative charge to the surface of the photoconductor 32. Because of this discharge operation, the photoconductor 32 is charged.

On the open side of the shield case 62 and between the discharge wire 64 and the photoconductor 32, a grid 66 having multiple openings is placed along the axis-of-rotation direction of the photoconductor 32.

In the grid 66, the negative charge generated by the discharge wire 64 passes through the openings in the grid 66 and is supplied to the photoconductor 32, and the passage amount of the negative charge passing through the grid 66 is controlled by a grid voltage applied from a power source (not shown). Thus, the charge potential of the photoconductor 32 is controlled.

Specifically, when the voltage (electrical potential) of the grid 66 is high with respect to the electrical potential of the photoconductor 32, the negative charge moves toward the photoconductor 32 because of that electrical potential difference, so the passage amount of the negative charge is large, and when the electrical potential difference between the photoconductor 32 and the grid 66 becomes smaller as a result of the negative charge being supplied to the photoconductor 32, the passage amount of the negative charge decreases.

Figure 4:
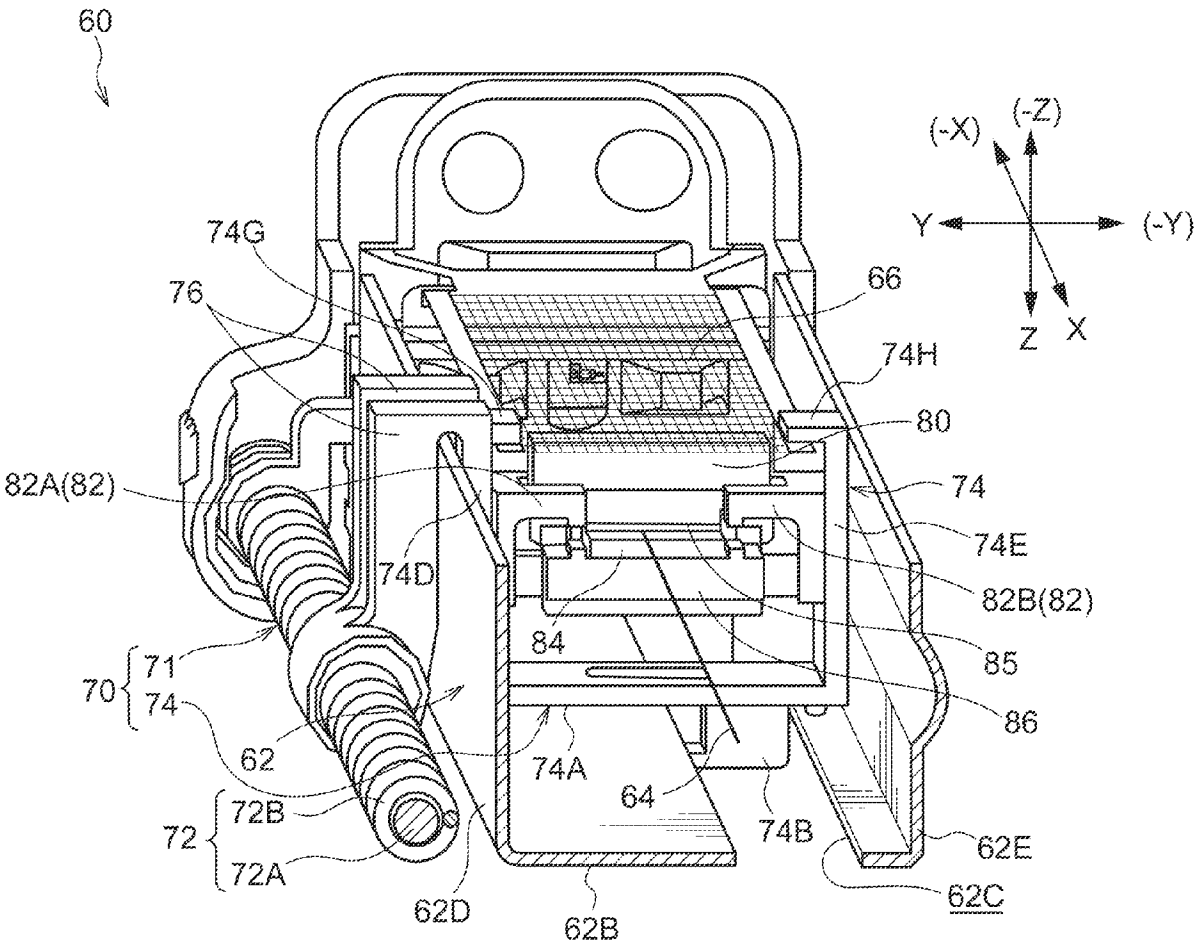
FIG. 4 is a perspective view showing a cutaway of part of the configuration of the charging device pertaining to the exemplary embodiment.
Figure 5:
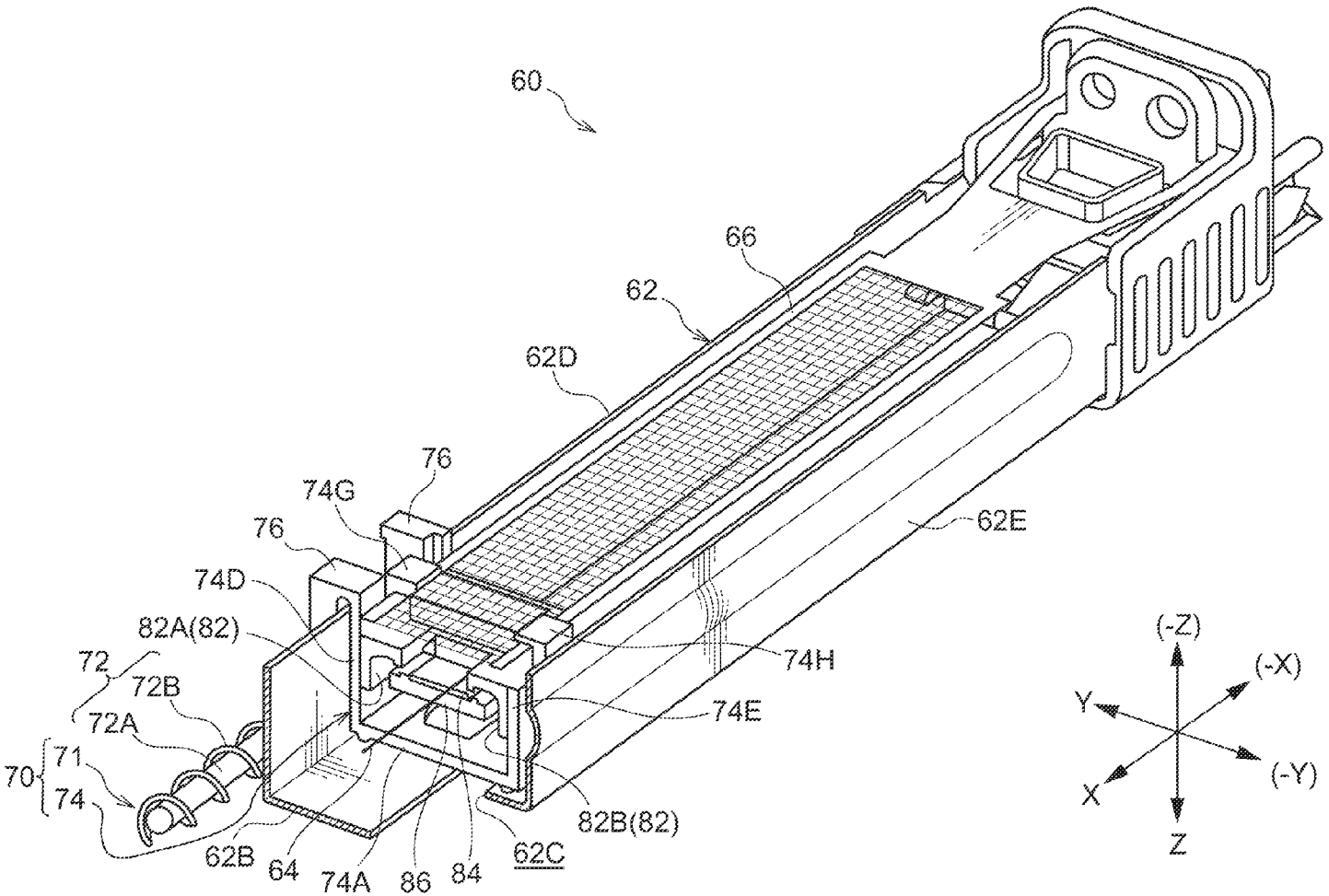
FIG. 5 is a perspective view showing a cutaway of part of the configuration of the charging device pertaining to the exemplary embodiment.

The charging device 60 is also, as shown in FIG. 4 and FIG. 5, equipped with a cleaning device 70 that cleans the discharge wire 64 and the grid 66. The cleaning device 70 is equipped with a cleaning device body 74, which is housed inside the shield case 62 so as to be movable along the lengthwise direction of the shield case 62, and a moving device 71, which moves the cleaning device body 74 in one direction and in the other direction of the lengthwise direction of the shield case 62.

The cleaning device body 74 is configured to include an upper plate 74A, which is placed along the inner surface of the upper wall 62B of the shield case 62, and side plates 74D and 74E, which are placed along the inner surfaces of side walls 62D and 62E of the shield case 62.

On the upper portion of the upper plate 74A, there is disposed a sandwiching portion 74B that extends out above the upper wall 62B of the shield case 62 through the ventilation opening 62C and sandwiches the upper wall 62B between itself and the upper plate 74A.

The moving device 71 is equipped with a feed screw 72 that is rotatably supported on the side portion of the side wall 62D of the shield case 62. The feed screw 72 is configured to include a rotating shaft 72A, which extends along the lengthwise direction of the shield case 62, and a thread 72B, which is formed helically on the outer periphery of the rotating shaft 72A.

In the cleaning device body 74, there is disposed a coupling portion 76 that is coupled to the feed screw 72. The coupling portion 76 extends out from the side plate 74D of the cleaning device body 74 towards the side of the side wall 62D and extends upward along the outer surface of the side wall 62D. Additionally, the feed screw 72 is screwed into the distal end portion of the coupling portion 76. The moving mechanism that moves the cleaning device body 74 is not limited to the feed screw 72 and may also, for example, be of a configuration using a mechanical element such as a belt.

In the present exemplary embodiment, as described above, the charging device 60 is configured such that the side wall 62D of the shield case 62 is sandwiched by the coupling portion 76 and the side plate 74D of the cleaning device body 74. Thus, the movement of the cleaning device body 74 in the direction of arrow Y and the direction of arrow −Y is regulated by the side wall 62D of the shield case 62, and the cleaning device body 74 is guided along the lengthwise direction of the shield case 62 (the direction of arrow X and the direction of arrow −X). That is, in the present exemplary embodiment, the side wall 62D of the shield case 62 functions as a guide member that guides the cleaning device body 74 (specifically, the side plate 74D and the coupling portion 76) in the direction of arrow X and the direction of arrow −X, and the side plate 74D of the cleaning device body 74 and the coupling portion 76 function as guided members.

The cleaning device body 74 is sandwiched by the side wall 62D and the side wall 62E between the side wall 62D and the side wall 62E of the shield case 62. That is, the movement of the cleaning device body 74 in the direction of arrow Y and the direction of arrow −Y is regulated also by the side wall 62D and the side wall 62E, and the cleaning device body 74 is guided along the lengthwise direction of the shield case 62 (the direction of arrow X and the direction of arrow −X). Consequently, in the present exemplary embodiment, it can also be said that the side wall 62D and the side wall 62E of the shield case 62 function as guide members that guide the cleaning device body 74 (specifically, the side plate 74D and the side plate 74E) in the direction of arrow X and the direction of arrow −X and that the side plate 74D and the side plate 74E of the cleaning device body 74 function as guided members.

Moreover, in the present exemplary embodiment, the charging device 60 is configured such that the upper wall 62B of the shield case 62 is sandwiched by the sandwiching portion 74B and the upper plate 74A of the cleaning device body 74. Thus, the movement of the cleaning device body 74 in the direction of arrow Z and the direction of arrow −Z is regulated by the upper wall 62B of the shield case 62, and the cleaning device body 74 is guided along the lengthwise direction of the shield case 62 (the direction of arrow X and the direction of −X). Consequently, in the present exemplary embodiment, it can also be said that the upper wall 62B of the shield case 62 functions as a guide member that guides the cleaning device body 74 (specifically the upper plate 74A and the sandwiching portion 74B) in the direction of arrow X and the direction of arrow −X and that the upper plate 74A and the sandwiching portion 74B of the cleaning device body 74 function as guided members. It suffices for the present exemplary embodiment to have at least one of the above-described configurations that functions as a guide member that guides the cleaning device body 74; further, as the guide member that guides the cleaning device body 74, another configuration may also be used.

Between the side plate 74D and the side plate 74E of the cleaning device body 74, there are disposed a grid cleaning member 80, which contacts and cleans the grid 66, and a support member 82, on which the grid cleaning member 80 is supported. The grid cleaning member 80 is configured by a so-called cleaning brush in which numerous hairs for cleaning are implanted.

On the side plate 74D and the side plate 74E, there are disposed grid sandwiching portions 74G and 74H for sandwiching the grid 66 between themselves and the grid cleaning member 80.

The support member 82 is, in the present exemplary embodiment, configured by two support members 82A and 82B, and each of those two support members 82A and 82B is formed in an L shape when seen from the front (when seen from one lengthwise direction end side of the shield case 62). One end portion of each of the support members 82A and 82B is fixed to the inner surfaces of the side plate 74D and the side plate 74E, and the grid cleaning member 80 is fixed to the other end portions of the support members 82A and 82B.

Further, between the side plate 74D and the side plate 74E of the cleaning device body 74 and between the upper wall 62B of the shield case 62 and the grid cleaning member 80, there are disposed a discharge wire cleaning member 84, which serves as one example of a cleaning member that contacts and cleans the discharge wire 64, and a support member 86, on which the discharge wire cleaning member 84 is supported.

In the present exemplary embodiment, the discharge wire cleaning member 84 is configured to be movable along the length direction of the discharge wire 64 as a result of being disposed in the cleaning device body 74 that is movable along the lengthwise direction of the shield case 62. Further, the discharge wire cleaning member 84 contacts the discharge wire 64 from above. The discharge wire cleaning member 84 is, for example, configured by a cloth member such as non-woven cloth or by a porous member such as foam. The support member 86 is fixed to the cleaning device body 74 via an elastic member (not shown) such as a spring and is pressed against the discharge wire 64.

In a position opposing the discharge wire cleaning member 84, there is disposed a discharge wire cleaning member 85 that sandwiches the discharge wire 64 between itself and the discharge wire cleaning member 84 and contacts and cleans the discharge wire 64 from below.

Figure 6:
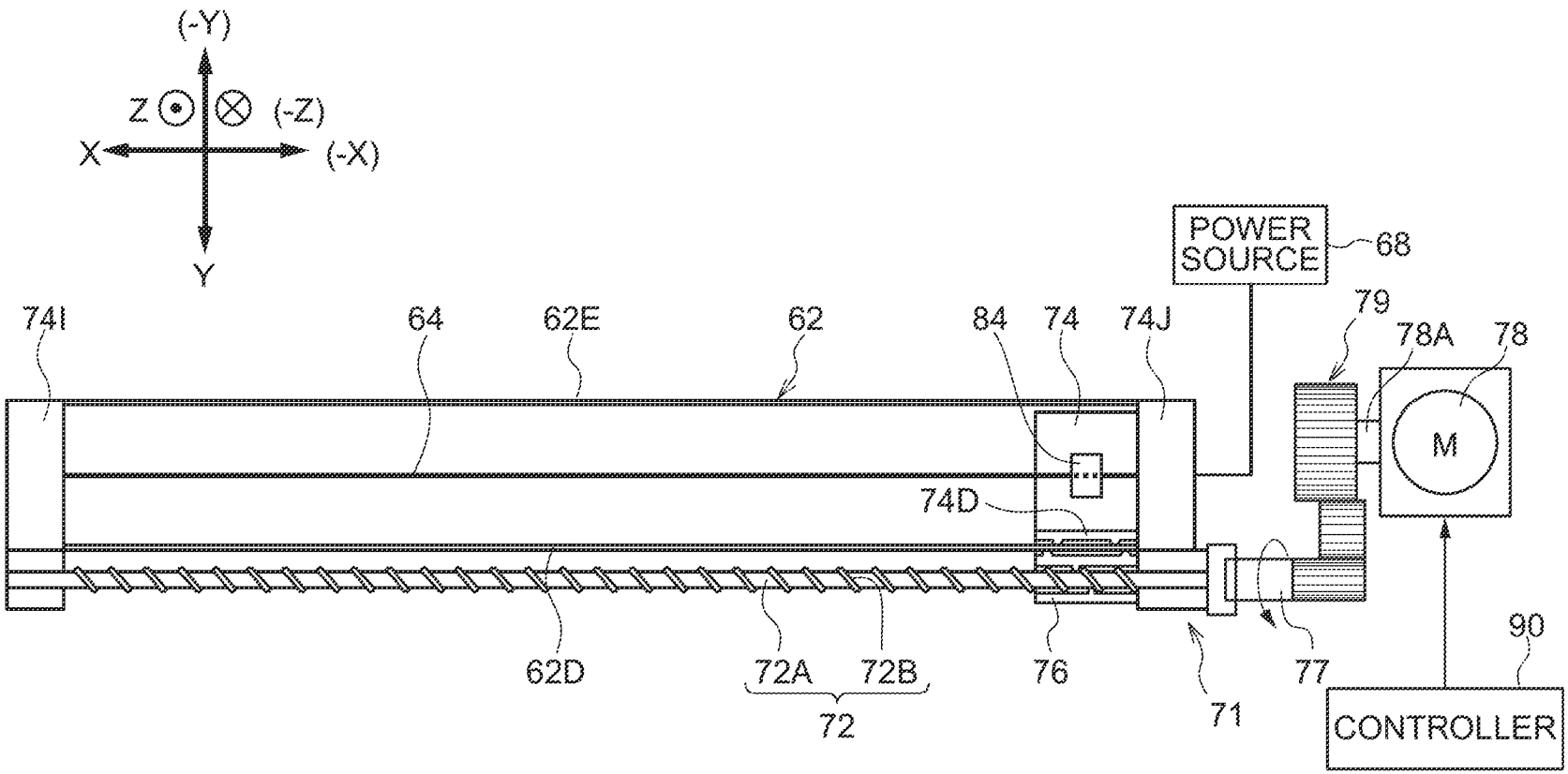
FIG. 6 is a general view showing the configuration of a cleaning device pertaining to the exemplary embodiment.

In the present exemplary embodiment, the feed screw 72 is, as shown in FIG. 6, configured to rotate as a result of driving force from a motor 78 serving as one example of a drive device being transmitted to the rotating shaft 72A via a gear train 79. Thus, in the cleaning device 70, when the feed screw 72 forwardly rotates, the cleaning device body 74 moves in one direction (the direction of arrow X in FIG. 6) of the lengthwise direction of the shield case 62, and when the feed screw 72 reversely rotates, the cleaning device body 74 moves in the other direction (the direction of arrow −X in FIG. 6) of the lengthwise direction of the shield case 62. In accompaniment with the movement of the cleaning device body 74, the grid cleaning member 80 wipes the grid 66, and the discharge wire cleaning member 84 and the discharge wire cleaning member 85 wipe the discharge wire 64, whereby the grid 66 and the discharge wire 64 are cleaned.

In the present exemplary embodiment, a standby position in which the cleaning device body 74 stands by when the cleaning device 70 is not performing a cleaning operation is set on one length direction end side of the discharge wire 64 (the shield case 62) and outside the range (charging range) in which the discharge wire 64 discharges with respect to the photoconductor 82. In FIG. 6, the cleaning device body 74 is shown in a state where it is positioned in the standby position.

Figure 7:
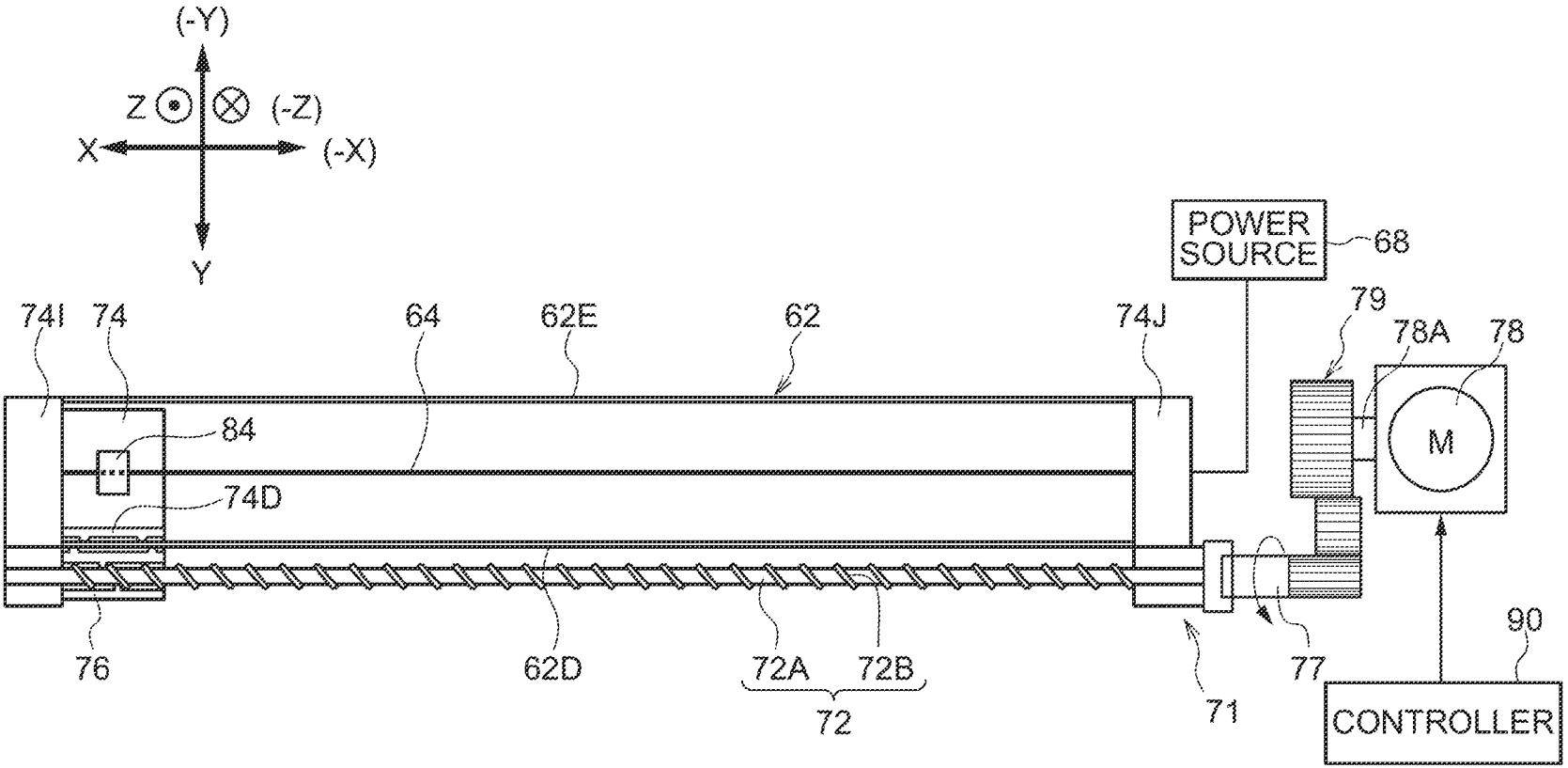
FIG. 7 is a general view showing a state where a cleaning device body is positioned in a turn-back position in the configuration of the cleaning device pertaining to the exemplary embodiment.

Further, in the present exemplary embodiment, the other end side of the shield case 62 is configured as a turn-back position at which the cleaning device body 74 turns back. In FIG. 7, the cleaning device body 74 is shown in a state where it is positioned in the turn-back position.

The cleaning device body 74 is configured such that, in the standby position, it is separated from the discharge wire 64 by an unillustrated separation mechanism (retract mechanism). Further, in the present exemplary embodiment, the cleaning device 70 does not have a detector that detects the position of the cleaning device body 74 including a detector that detects that the cleaning device body 74 is positioned in the standby position.

In the transmission path on which the driving force from the motor 78 is transmitted to the rotating shaft 72A, there is disposed a torque limiter 77 that allows a drive shaft 78A of the motor 78 to idle when a predetermined rotational load arises in the rotating shaft 72A.

Thus, when the cleaning device body 74 is positioned in the standby position and a driving force in the direction of arrow −X is applied with respect to the cleaning device body 74, a rotational load exceeding the predetermined rotational load arises in the feed screw 72 as a result of the cleaning device body 74 striking a side wall 74J and not advancing, and the drive shaft 78A of the motor 78 idles.

Further, when the cleaning device body 74 is positioned in the turn-back position and a driving force in the direction of arrow X is applied with respect to the cleaning device body 74, a rotational load exceeding the predetermined rotational load arises in the feed screw 72 as a result of the cleaning device body 74 striking a side wall 741 and not advancing, and the drive shaft 78A of the motor 78 idles.

In the present exemplary embodiment, as described above, the feed screw 72 that produces a moving force with respect to the cleaning device body 74 is disposed on one side of the shield case 62, so it becomes easier for the cleaning device body 74 to tilt with respect to the shield case 62 when the cleaning device 74 moves.

Further, in the present exemplary embodiment, the cleaning device body 74 is configured by resin, which is an insulator, and the shield case 62 and the feed screw 72 are configured by metal. When the cleaning device body 74 is put into reciprocal motion, it moves while the cleaning device body 74 and the shield case 62 come into contact with and separate from each other, or moves while being pressed against one side, because of gutters (clearances) between it and the shield case 62. In so doing, sometimes the portions of the cleaning device body 74, which is configured by resin, that contact the shield case 62, which is configured by metal, become worn down over time such that the frictional force gradually becomes larger. When the phenomenon of the frictional force becoming larger is observed, there is seen a phenomenon (gnawing) where the cleaning device body 74 is pressed against one side of the shield case 62, tilting becomes larger on the opposite side because of that reaction force, and for that reason the cleaning device body 74 is further pressed against the one side of the shield case 62 such that friction increases.

Due to these, sometimes the cleaning device body 74 ends up catching on the side wall 62D or the side wall 62E of the shield case 62 as a result of the cleaning device body 74 tilting with respect to the shield case 62, and the cleaning device body 74 stops.

Further, in the motor 78, there is disposed a controller 90 that controls the driving of the motor 78. Specifically, the controller 90 manages the rotational time (rotational amount) of the motor 78 and causes the motor 78 to move the cleaning device body 74 to the desired position.

In the present exemplary embodiment, the cleaning device 70 is configured such that a cleaning operation, where the cleaning device body 74 is reciprocally moved from the standby position along the shield case 62, and a return operation, where the cleaning device body 74 is returned to the standby position along the shield case 62, are executed as a result of the controller 90 controlling the driving of the motor 78. The cleaning operation and the return operation are both moving operations of the cleaning device body 74 whose terminal points are the standby position.

Additionally, in the present exemplary embodiment, because of the drive control by the controller 90, the motor 78 is configured such that, when executing at least one of the cleaning operation and the return operation, it applies to the cleaning device body 74 a driving force in an opposite direction of a moving direction in which movement of the cleaning device body 74 is to be started and thereafter applies to the cleaning device body 74 a driving force in the moving direction. In the present exemplary embodiment, the moving direction in which movement of the cleaning device body 74 is to be started specifically is the direction of arrow X (the direction towards the turn-back position) in the cleaning operation and the direction of arrow −X (the direction towards the standby position) in the return operation. The specific moving operation of the cleaning device body 74 will be described later.

In the present exemplary embodiment, the return operation of returning the cleaning device body 74 to the standby position is performed by operation from an operation portion 54 (see FIG. 1). This return operation is executed as a result of an operation by a user from the operation portion 54 when, for example, charging trouble has arisen as a result of the cleaning device body 74 ending up stopping on the turn-back position side of the standby position in the cleaning operation or the like and image defects such as black bands resulting from that charging trouble have arisen. The operation from the operation portion 54 may also be turning on power after turning off power.

Further, in the present exemplary embodiment, because the cleaning device 70 does not have a detector that detects the position of the cleaning device body 74, the return operation is performed when there is the potential for the cleaning device body 74 to not be positioned in the standby position. Specifically, the return operation is, for example, performed before discharge of the discharge wire 64 when power has been turned on in the image forming apparatus body 11. In a state where power is not turned on, it is possible for the user to access the cleaning device 70 and move the cleaning device body 74, so there is the potential for the cleaning device body 74 to not be positioned in the standby position. Power is, for example, turned on from the operation portion 54 (see FIG. 1).

Further, the return operation is performed before discharge of the discharge wire 64 when the charging device 60 has been installed in the image forming apparatus body 11. In a state where the charging device 60 is removed from the image forming apparatus body 11, it is possible for the user to access the cleaning device 70 and move the cleaning device body 74, so there is the potential for the cleaning device body 74 to not be positioned in the standby position. Installation of the charging device 60 in the image forming apparatus body 11 is performed when the charging device 60 installed in the image forming apparatus body 11 is temporarily removed to replace or perform maintenance on a part and is reinstalled and when the charging device 60 installed in the image forming apparatus body 11 is removed and a new charging device 60 is installed in the image forming apparatus body 11 (so as to replace the previously installed charging device 60).

In the present exemplary embodiment, a fuse is disposed in the new charging device 60, and the fact that the charging device 60 is new is detected as a result of the fuse being cut when the new charging device 60 is installed in the image forming apparatus body 11. Further, the fact that the charging device 60 that has been removed from the image forming apparatus body 11 has been reinstalled in the image forming apparatus body 11 is detected by a detector (not shown).

The cleaning operation is, for example, executed each time the image forming apparatus 10 forms images on a predetermined number of sheets (e.g., 3,000 sheets). Both when power has been turned on in the image forming apparatus body 11 and when the charging device 60 has been installed in the image forming apparatus body 11, there is the potential for the discharge wire 64 and the grid 66 to be dirty, so the cleaning device 70 may also be configured to perform the cleaning operation after the return operation or instead of the return operation.

(Action Pertaining to Present Exemplary Embodiment)

Next, the action pertaining to the present exemplary embodiment will be described.

First, the cleaning operation in the cleaning device 70 will be described. Here, first, the cleaning operation executed each time the image forming apparatus 10 forms images on the predetermined number of sheets (e.g., 3,000 sheets) will be described.

When images are formed on the predetermined number of sheets (e.g., 3,000 sheets) by the image forming section 14 after the cleaning device 70 has performed the cleaning operation a previous time, the controller 90 drives the motor 78 such that the feed screw 72 forwardly rotates an amount corresponding to the rotational amount by which the cleaning device body 74 reaches the turn-back position from the standby position. Thus, the cleaning device body 74 moves from the standby position (see FIG. 6) to the turn-back position (see FIG. 7) along one direction (the direction of arrow X) of the lengthwise direction of the shield case 62.

In this manner, when the cleaning device body 74 moves, the discharge wire 64 is cleaned from one lengthwise direction end portion thereof to its other end portion by the discharge wire cleaning member 84 and the discharge wire cleaning member 85, and the grid 66 is cleaned from one lengthwise direction end portion thereof to its other end portion by the grid cleaning member 80.

Figure 8:
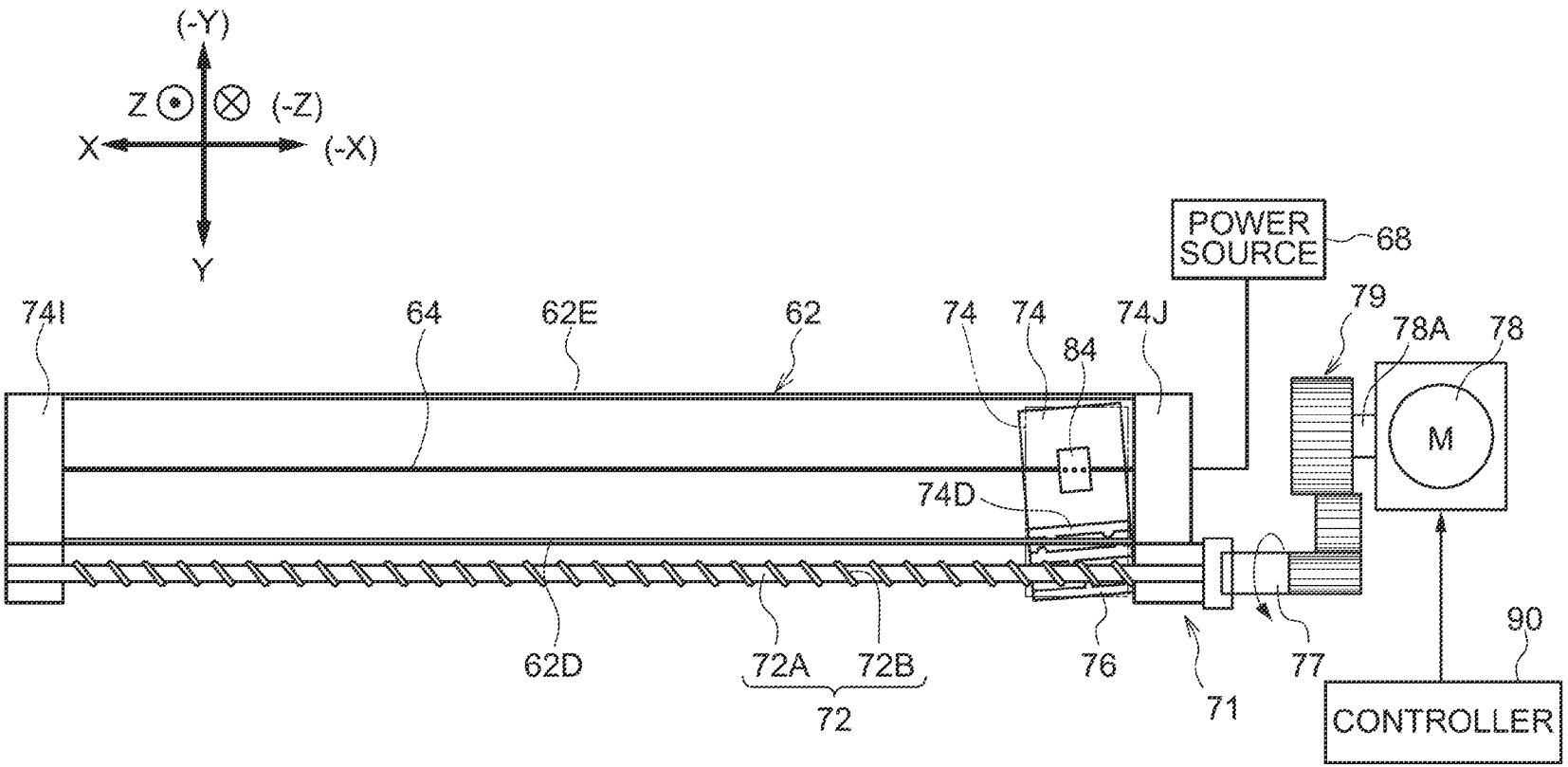
FIG. 8 is a general view showing a state where the cleaning device body is tilted in a standby position in the cleaning device pertaining to the exemplary embodiment.

In a case where the cleaning device body 74 is tilted in the standby position with respect to the shield case 62 as indicated by the solid lines in FIG. 8, the posture of the cleaning device body 74 changes as a result of the feed screw 72 forwardly rotating, so that the tilting of the cleaning device body 74 is eliminated as indicated by the two-dot chain lines in FIG. 8, and thereafter the cleaning device body 74 moves from the standby position to the turn-back position along one direction (the direction of arrow X) of the lengthwise direction of the shield case 62. For this reason, a situation where the cleaning device body 74 catches on the side wall 62D or the side wall 62E of the shield case 62 and stops is eliminated or prevented.

Figure 9:
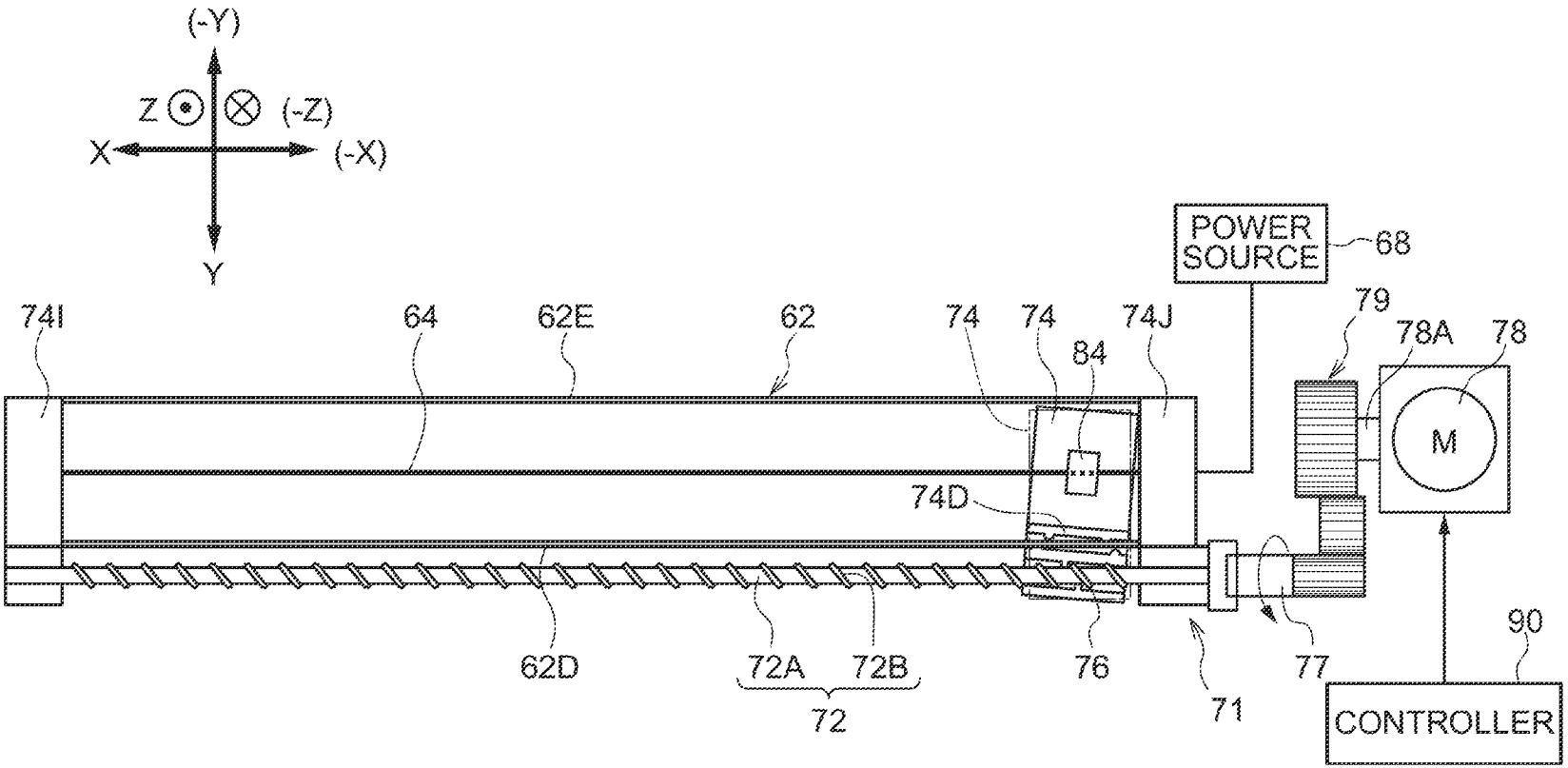
FIG. 9 is a general view showing a state where the cleaning device body is tilted towards the opposite side of the direction in FIG. 8 when the cleaning device body is in the standby position in the cleaning device pertaining to the exemplary embodiment.

Before the feed screw 72 is forwardly rotated, that is, before the cleaning device body 74 is moved from the standby position (see FIG. 6) to the turn-back position (see FIG. 7), the controller 90 may also drive the motor 78 such that the feed screw 72 reversely rotates one to two rotations. Thus, in a case where the cleaning device body 74 is tilted in the standby position as indicated by the solid lines in FIG. 9, the posture of the cleaning device body 74 changes, so that the tilting is eliminated as indicated by the two-dot chain lines in FIG. 9. For this reason, a situation where the cleaning device body 74 catches on the side wall 62D or the side wall 62E of the shield case 62 and stops is eliminated or prevented.

Next, the controller 90 drives the motor 78 such that the feed screw 72 reversely rotates an amount corresponding to the rotational amount by which the cleaning device body 74 reaches the standby position from the turn-back position. Thus, the cleaning device body 74 moves from the turn-back position (see FIG. 7) to the standby position (see FIG. 6) along the other direction (the direction of arrow −X) of the lengthwise direction of the shield case 62, the discharge wire 64 is cleaned by the discharge wire cleaning member 84 and the discharge wire cleaning member 85, and the grid 66 is cleaned by the grid cleaning member 80.

Next, the return operation of returning the cleaning device body 74 to the standby position will be described.

The return operation is performed before discharge of the discharge wire 64 when the charging device 60 has been reinstalled in the image forming apparatus body 11. The return operation is also performed before discharge of the discharge wire 64 when a new charging device 60 has been installed in the image forming apparatus body 11. The return operation is also performed before discharge of the discharge wire 64 when power has been turned on in the image forming apparatus body 11. The return operation is also executed as a result of the user operating from the operation portion 54 when, for example, charging trouble has arisen as a result of the cleaning device body 74 ending up stopping on the turn-back position side of the standby position in the cleaning operation or the like and image defects such as black bands resulting from that charging trouble have arisen.

Figure 10:
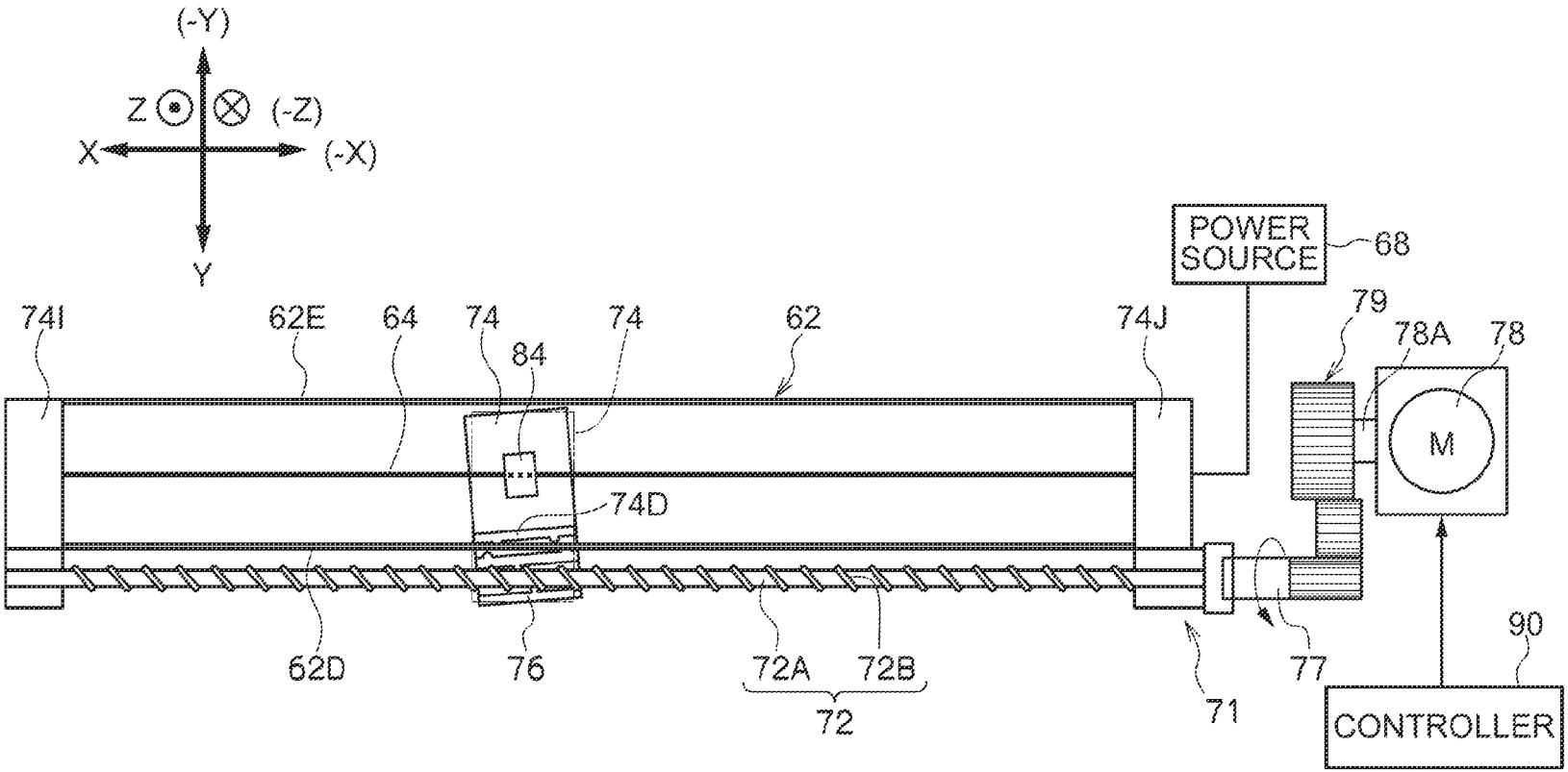
FIG. 10 is a general view showing a state where the cleaning device body is tilted outside the standby position in the cleaning device pertaining to the exemplary embodiment.

When the return operation is executed, the controller 90 drives the motor 78 such that the feed screw 72 forwardly rotates one to two rotations. Thus, in a case where the cleaning device body 74 is tilted as indicated by the solid lines in FIG. 10, the posture of the cleaning device 74 changes, so that the tilting is eliminated as indicated by the two-dot chain lines in FIG. 10. In a case where the cleaning device body 74 is not tilted, the cleaning device body 74 moves a little in the direction of arrow X in correspondence to the feed screw 72 making one to two rotations.

In the present exemplary embodiment, the controller 90 drives the motor 78 such that the feed screw 72 forwardly rotates one to two rotations as a rotational amount (rotational time) in a minimum range in which the posture of the cleaning device body 74 becomes corrected (changes), but the rotational amount (rotational time) for correcting the posture of the cleaning device body 74 may also be three or more rotations; it suffices for the rotational amount (rotational time) to be a rotational amount (rotational time) that is smaller than the rotational amount for returning the cleaning device body 74 to the standby position and specifically a rotational amount (rotational time) that is smaller than the rotational amount by which the cleaning device body 74 reaches the standby position from the turn-back position. It suffices for the rotational amount (rotational time) to be in a range in which the posture of the cleaning device body 74 becomes corrected (changes).

Figure 11:
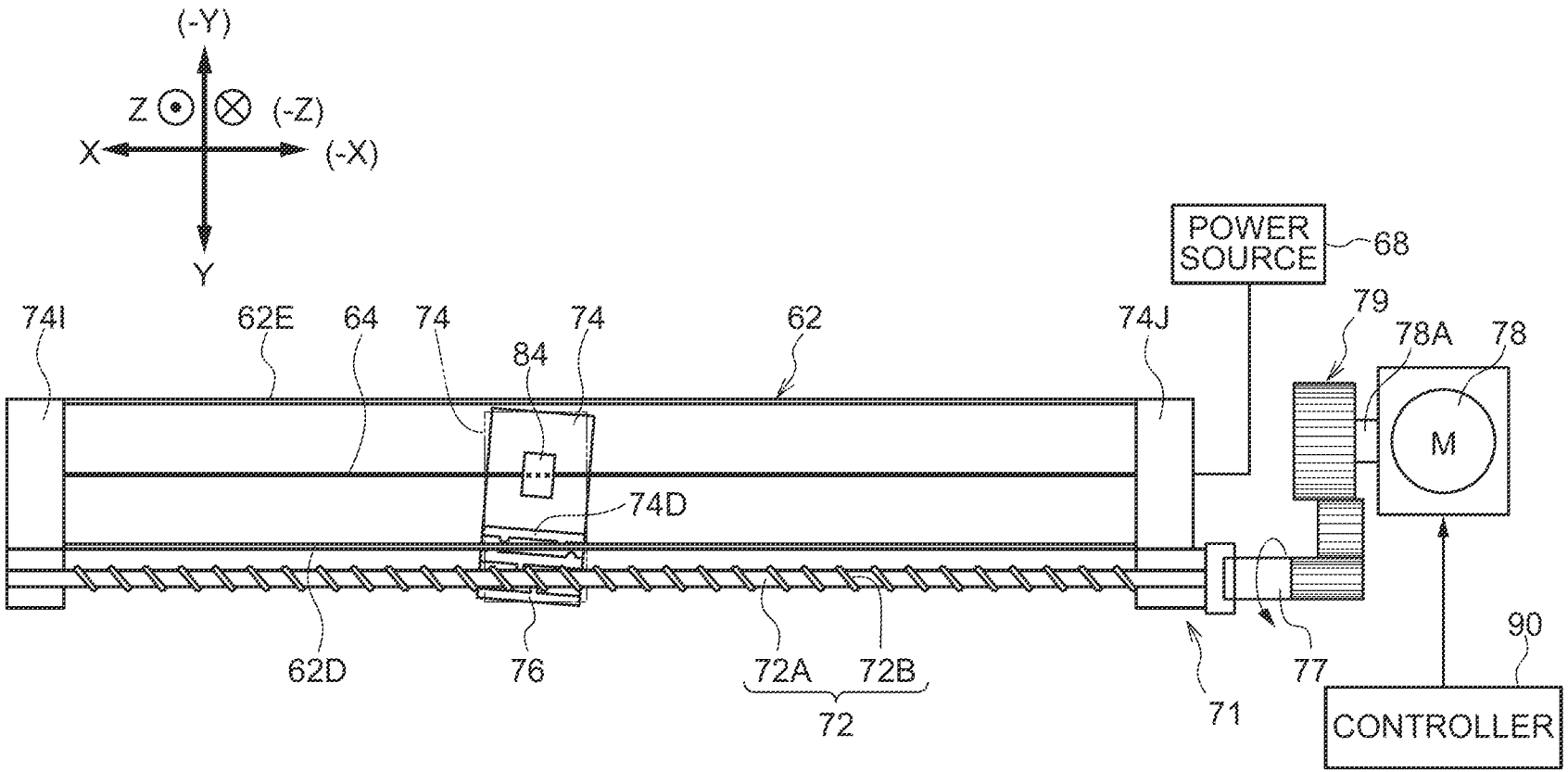
FIG. 11 is a general view showing a state where the cleaning device body is tilted towards the opposite side of the direction in FIG. 10 when the cleaning device body is outside the standby position in the cleaning device pertaining to the exemplary embodiment.

Next, the controller 90 drives the motor 78 such that the feed screw 72 reversely rotates an amount corresponding to the rotational amount by which the cleaning device body 74 reaches the standby position from the turn-back position. Thus, in a case where the cleaning device body 74 is tilted as indicated by the solid lines in FIG. 11, the posture of the cleaning device body 74 changes, so that the tilting is eliminated as indicated by the two-dot chain lines in FIG. 11. Moreover, the cleaning device body 74 moves in the other direction (the direction of arrow −X) of the lengthwise direction of the shield case 62. In a case where the cleaning device body 74 is not tilted, the cleaning device body 74 simply moves in the other direction (the direction of arrow −X) of the lengthwise direction of the shield case 62.

In a case where the cleaning device body 74 is not positioned in the turn-back position at the time when the feed screw 72 has started reversely rotating, that is, in a case where the cleaning device body 74 is positioned on the standby position side of the turn-back position, the feed screw 72 is reversely rotated even after the cleaning device body 74 has reached the standby position, but a rotational load arises in the feed screw 72 as a result of the cleaning device body 74 striking the side wall 74J in the standby position and not advancing, and the drive shaft 78A of the motor 78 idles because of the torque limiter 77.

In this manner, when the return operation is executed, the motor 78 applies to the cleaning device body 74 a driving force in the direction of arrow X, which is the opposite direction of the moving direction (the direction of arrow −X) in which movement of the cleaning device body 74 is to be started in the execution of the cleaning operation, and thereafter the motor 78 moves the cleaning device body 74 in the direction of arrow −X. Thus, the tilting of the cleaning device body 74 that has stopped outside the standby position as a result of its posture tilting with respect to the shield case 64 is eliminated, and the cleaning device body 74 returns to the standby position.

In the present exemplary embodiment, the return operation described above is performed to return the cleaning device body 74 to the standby position by turning on power in the image forming apparatus body 11 or by installing the charging device 60 in the image forming apparatus body 11, so it becomes unnecessary to detect the position of the cleaning device body 74.

When the charging device 60 is reinstalled in the image forming apparatus body 11, or when a new charging device 60 is installed in the image forming apparatus body 11, or when power is turned on in the image forming apparatus body 11, there is also the potential for the discharge wire 64 and the grid 66 to be dirty, so the cleaning operation described above may also be performed after the return operation described above has been performed.

Moreover, when the charging device 60 is reinstalled in the image forming apparatus body 11, or when a new charging device 60 is installed in the image forming apparatus body 11, or when power is turned on in the image forming apparatus body 11, the cleaning operation described below may also be performed instead of the return operation described above.

When the cleaning operation is executed, the controller 90 drives the motor 78 such that the feed screw 72 reversely rotates one to two rotations. Thus, in a case where the cleaning device body 74 is tilted as indicated by the solid lines in FIG. 11, the posture of the cleaning device body 74 changes, so that the tilting is eliminated as indicated by the two-dot chain lines in FIG. 11. In a case where the cleaning device body 74 is not tilted, the cleaning device body 74 moves a little in the direction of arrow −X in correspondence to the feed screw 72 making one to two rotations.

In the present exemplary embodiment, the controller 90 drives the motor 78 such that the feed screw 72 reversely rotates one to two rotations as a rotational amount (rotational time) in a minimum range in which the posture of the cleaning device body 74 becomes corrected (changes), but the rotational amount (rotational time) for correcting the posture of the cleaning device body 74 may also be three or more rotations; it suffices for the rotational amount (rotational time) to be a rotational amount (rotational time) that is smaller than the rotational amount for moving the cleaning device body 74 to the turn-back position and specifically a rotational amount (rotational time) that is smaller than the rotational amount by which the cleaning device body 74 reaches the turn-back position from the standby position. It suffices for the rotational amount (rotational time) to be in a range in which the posture of the cleaning device body 74 becomes corrected (changes).

Next, the controller 90 drives the motor 78 such that the feed screw 72 forwardly rotates an amount corresponding to the rotational amount by which the cleaning device body 74 reaches the turn-back position from the standby position. Thus, in a case where the cleaning device body 74 is tilted as indicated by the solid lines in FIG. 10, the posture of the cleaning device body 74 changes, so that the tilting is eliminated as indicated by the two-dot chain lines in FIG. 10. Moreover, the cleaning device body 74 moves in one direction (the direction of arrow X) of the lengthwise direction of the shield case 62. In a case where the cleaning device body 74 is not tilted, the cleaning device body 74 simply moves in the one direction (the direction of arrow X) of the lengthwise direction of the shield case 62.

In a case where the cleaning device body 74 is positioned in the standby position at the time when the feed screw 72 has started forwardly rotating, the cleaning device body 74 moves from the standby position to the turn-back position. Thus, the discharge wire 64 is cleaned from one lengthwise direction end portion thereof to its other end portion by the discharge wire cleaning member 84 and the discharge wire cleaning member 85, and the grid 66 is cleaned from one lengthwise direction end portion thereof to its other end portion by the grid cleaning member 80.

In a case where the cleaning device body 74 is not positioned in the standby position at the time when the feed screw 72 has start forwardly rotating, that is, when the cleaning device body 74 is positioned on the turn-back position side of the standby position, the feed screw 72 forwardly rotates even after the cleaning device body 74 has reached the turn-back position, but a rotational load arises in the feed screw 72 as a result of the cleaning device body 74 striking the side wall 741 in the turn-back position and not advancing, and the drive shaft 78A of the motor 78 idles because of the torque limiter 77.

Next, the controller 90 drives the motor 78 such that the feed screw 72 reversely rotates an amount corresponding to the rotational amount by which the cleaning device body 74 reaches the standby position from the turn-back position. Thus, the cleaning device body 74 moves in the other direction (the direction of arrow −X) of the lengthwise direction of the shield case 62 from the turn-back position to the standby position, the discharge wire 64 is cleaned by the discharge wire cleaning member 84 and the discharge wire cleaning member 85, and the grid 66 is cleaned by the grid cleaning member 80.

In this manner, when the cleaning operation is executed, the motor 78 applies to the cleaning device body 74 a driving force in the direction of arrow −X, which is the opposite direction of the moving direction (the direction of arrow X) in which movement of the cleaning device body 74 is to be start in the execution of the cleaning operation, and thereafter moves the cleaning device body 74 in the direction of arrow X. Thus, the tilting of the cleaning device body 76 that has stopped outside the standby position as a result of its posture tilting with respect to the shield case 62 is eliminated, and the cleaning device body 74 returns to the standby position.

In the present exemplary embodiment, the cleaning operation described above is performed to return the cleaning device body 74 to the standby position by turning on power in the image forming apparatus body 11 or by installing the charging device 60 in the image forming apparatus body 11, so it becomes unnecessary to detect the position of the cleaning device body 74.

Further, in this manner, in the present exemplary embodiment, a detector itself that detects the position of the cleaning device body 74 is unnecessary, and a member that electrically protects the detector from the voltage applied to the discharge wire 64 is also unnecessary, so the device can be made compact. The configuration of the present exemplary embodiment is also applicable to a configuration having a detector that detects the position of the cleaning device body 74.

The present invention is not limited to the exemplary embodiment described above, and various modifications, alterations, and improvements are possible.

What is claimed is:

1. A cleaning device comprising:

a cleaning member that is disposed so as to be movable along a length direction of, and in contact with, a discharge member of a charging device and cleans the discharge member;

a guide member that is disposed along the length direction of the discharge member and guides the cleaning member in the length direction of the discharge member; and a drive device which, when executing a cleaning operation where the drive device reciprocally moves the cleaning member along the guide member from a standby position set on one length direction end portion of the discharge member or a return operation where the drive device returns the cleaning member along the guide member to the standby position, applies to the cleaning member, resting at the standby position, a driving force in an opposite direction of a moving direction in which movement of the cleaning member is to be started and thereafter applies to the cleaning member a driving force in the moving direction.

2. An image forming apparatus comprising:

an image forming apparatus body that has an image forming section including the charging device; and the cleaning device according to claim 1, which is disposed in the image forming apparatus body, wherein before discharge of the discharge member is performed in a case where power has been turned on in the image forming apparatus body, the drive device applies to the cleaning member the driving force in the opposite direction and thereafter applies to the cleaning member the driving force in the moving direction.

3. An image forming apparatus comprising:

an image forming apparatus body that has an image forming section including the charging device; and the cleaning device according to claim 1, wherein before discharge of the discharge member is performed when the cleaning device is installed in the image forming apparatus body, the drive device applies to the cleaning member the driving force in the opposite direction and thereafter applies to the cleaning member the driving force in the moving direction.

4. The cleaning device according to claim 1, wherein during a cleaning operation, the drive device reciprocally moves the cleaning member along the guide member from a standby position set on one length direction end portion of the discharge member.

5. The cleaning device according to claim 1, wherein during a return operation, the drive device returns the cleaning member along the guide member to the standby position.

6. The cleaning device according to claim 1, wherein the moving device comprises a feed screw that is rotatably supported by the guide device.

* * * * *